US008226096B2

(12) United States Patent
Reyes, Jr.

(10) Patent No.: US 8,226,096 B2
(45) Date of Patent: Jul. 24, 2012

(54) MOBILE PLATFORM ASSEMBLY

(76) Inventor: Jaime Alberto Reyes, Jr., Pembroke Pines, FL (US)

( * ) Notice: Subject to any disclaimer, the term of this patent is extended or adjusted under 35 U.S.C. 154(b) by 207 days.

(21) Appl. No.: 12/653,844

(22) Filed: Dec. 18, 2009

(65) Prior Publication Data

US 2011/0148063 A1 Jun. 23, 2011

(51) Int. Cl.
*A63C 17/06* (2006.01)

(52) U.S. Cl. ..... 280/87.042; 280/11.226

(58) Field of Classification Search ..... 280/87.01, 280/87.021, 87.041, 87.042, 87.043, 63, 280/78, 11.19, 11.223, 11.216, 11.221, 11.226, 280/11.24

See application file for complete search history.

(56) References Cited

U.S. PATENT DOCUMENTS

| | | | | |
|---|---|---|---|---|
| 108,184 | A | 10/1870 | Pollitt | |
| 904,088 | A | 11/1908 | Rother | |
| 3,351,353 | A | 11/1967 | Weitzner | |
| 3,355,185 | A | 11/1967 | Carter | |
| 3,379,454 | A | 4/1968 | Woodman | |
| 3,512,798 | A | 5/1970 | Siegel | |
| 4,043,566 | A * | 8/1977 | Johnson | 280/87.042 |
| 4,076,263 | A | 2/1978 | Rand | |
| 4,106,786 | A | 8/1978 | Talbott | |
| 4,149,735 | A | 4/1979 | Blackburn et al. | |
| 4,150,838 | A * | 4/1979 | Lappage | 280/87.042 |
| 4,168,076 | A * | 9/1979 | Johnson | 280/11.216 |
| 4,191,371 | A | 3/1980 | Armer, Jr. | |
| 4,225,147 | A | 9/1980 | Lowery | |
| 4,445,699 | A | 5/1984 | Darasko | |
| 4,572,529 | A | 2/1986 | Thomas | |
| 4,618,158 | A | 10/1986 | Liberkowski | |
| D346,418 | S * | 4/1994 | Fischbach | D21/765 |
| 5,409,265 | A | 4/1995 | Douglass | |
| 5,549,331 | A | 8/1996 | Yun et al. | |
| 5,590,890 | A | 1/1997 | Rosso et al. | |
| 5,716,074 | A | 2/1998 | Theodorou | |
| 6,065,762 | A | 5/2000 | Brelvi | |
| 6,293,565 | B1 | 9/2001 | Bouchard et al. | |
| 6,568,695 | B2 * | 5/2003 | Dornan | 280/87.042 |
| 6,616,583 | B1 | 9/2003 | Stack | |
| 6,637,827 | B2 | 10/2003 | Hurwitz | |
| 6,698,776 | B2 | 3/2004 | Todd | |
| 6,705,977 | B1 | 3/2004 | Ziak | |
| 6,848,750 | B2 | 2/2005 | Hurwitz | |
| 6,899,344 | B1 | 5/2005 | Raynor | |
| 7,172,044 | B2 * | 2/2007 | Bouvet | 180/181 |
| 2001/0052683 | A1 * | 12/2001 | Vance | 280/87.041 |
| 2002/0070514 | A1 | 6/2002 | Costa, Jr. et al. | |
| 2003/0146584 | A1 | 8/2003 | Gaus | |
| 2003/0146586 | A1 | 8/2003 | Hurwitz | |
| 2005/0146100 | A1 | 7/2005 | Hurwitz | |
| 2005/0285363 | A1 * | 12/2005 | Joung et al. | 280/87.041 |
| 2006/0287173 | A1 | 12/2006 | Guadagno | |
| 2007/0235970 | A1 | 10/2007 | Stillinger | |

* cited by examiner

*Primary Examiner* — John Walters
(74) *Attorney, Agent, or Firm* — Malloy & Malloy, P.L.

(57) ABSTRACT

A mobile platform such as, but not limited to, a skateboard or roller skate type of structure capable of movably transporting an individual over a supporting surface. A wheel assembly connected to the platform includes at least one but more practically a plurality of wheels each having a spherical configuration extending outwardly from opposite surfaces of the platform. A mounting assembly and each of a plurality of different embodiments of a bearing assembly are structured to facilitate a substantially universal, rotational movement of said wheel(s) relative to said platform. The different embodiments of the bearing assembly facilitate either a free or unrestricted universal rotational movement of the one wheel relative to the platform or alternatively a universal, rotational movement thereof concurrently about more defined rotational axes.

22 Claims, 14 Drawing Sheets

MOBILE PLATFORM ASSEMBLY

CLAIM OF PRIORITY

The present application is a continuation-in-part application of previously filed, now pending application having Ser. No. 12/653,843, filed on Dec. 18, 2009 incorporated herein by reference.

BACKGROUND OF THE INVENTION

1. Field of the Invention

This invention is directed to a mobile platform assembly such as, but not limited to, a skateboard, roller skate, etc. and including at least one but more practically a plurality of spherically configured wheels, each movably interconnected to the platform by a bearing assembly and a mounting assembly. Each bearing assembly is cooperatively disposed and structured with a corresponding mounting assembly to facilitate movement of a corresponding spherical wheel through a substantially universal, rotational range of motion relative to the platform.

2. Description of the Related Art

Numerous types of mobile support platforms have been known and utilized for years. The popularity of such structures has even risen to the level where the use thereof defines an "extreme" sport. As such, skateboards or other mobile platforms are utilized by skilled riders to perform a variety of difficult maneuvers. While not limited to skateboards, mobile platforms include various types of wheel structures adaptable for use in the performance of sporting maneuvers as well as recreation, exercising, and travel for relatively short distances. Mobile platforms of the type referred to include roller skates, rollerblades as well the aforementioned skateboards. In use, these types of platforms are manually propelled and are dimensioned and configured to support one or both of the individual's feet as the platform travels over a variety of different supporting surfaces.

As set forth above, skateboards in particular have become widely developed and generally comprise an elongated platform large enough for an individual to be supported in an upright or standing orientation. The wheel assembly associated therewith typically includes a front wheel structure and a rear wheel structure, wherein the portion of the platform extending between such front and rear wheel structures are sufficient to support the riding individual in the manner described.

In addition, various types of roller skate designs have been popularized for sporting, recreational and entertainment uses. As conventionally designed and structured, roller skates normally include a plurality of two pairs of substantially disk shaped wheels each supported on either a leading and trailing axle, wherein the two axles are disposed generally adjacent a front and rear portion a skate base respectively. As such, sufficient stability is provided for the user to move and/or be transported over a variety of different surfaces while also performing a variety of different maneuvers. More recently developed shoe skates are commonly known as "blade" skates, "inline" skates and/or rollerblades, which normally comprise a plurality of disk shaped wheels disposed in a linearly aligned relation to one another as they collectively extend along the length of the sole or base portion of the shoe skate on which they are mounted.

While structures of the type set forth above have enjoyed extensive popularity over many years, they are at least generally recognized as being at least partially restrictive, at least to the extent of allowing the rider or user to perform movements incorporating a somewhat limited degree of maneuverability. To overcome such disadvantages, an additional wheel assembly or wheel structure has been incorporated in skates, skateboards and other mobile platforms wherein one or all of the wheels include a spherical configuration. Accordingly, while spherical wheels have been generally known, the attachment or movable interconnection of this type of wheel to the under portion of the support platform also presents problems and/or disadvantages.

Such disadvantages are typically related to a relatively limited range of motion of the spherical wheel(s) thereby restricting maneuverability of the mobile platform to which such one or more wheels are attached. More specifically, known and conventional interconnecting and/or mounting structures associated with spherical wheels frequently diminish the potential freedom of movement which an improved spherical wheel assembly and appropriate mounting assembly could accomplish. In addition, the use of spherical or ball-shaped wheels may also suffer from problems and disadvantages associated with stability and/or maintenance problems. Similar to the above recognized disadvantages, such reliability problems could also be the result of at least partially ineffective connecting or mounting structures used to movably interconnect the spherical or ball type wheels to the support platform.

Accordingly, there is a need in this area for a support platform assembly capable of supporting and/or transporting an individual over a variety of different surfaces. Such a preferred and proposed mobile platform assembly should overcome the problems and disadvantages recognized in known and conventional mobile platforms, of this type, by providing sufficient maneuverability while reliably and efficiently interconnecting the wheel assembly to the platform. Also, the adaptability of an appropriate wheel assembly to a variety of different types of support platforms including skateboards, roller skates, etc. should be such as to increase the performance of all such mobile support platforms. Finally, a proposed and preferred mobile support platform which incorporates a versatile and high performance wheel assembly should be designed and structured for commercial development at a reasonable cost and price so as to be available to a greater portion of the consuming public.

SUMMARY OF THE INVENTION

The present invention is directed to an assembly structured to movably support or transport an individual over a variety of different supporting surfaces. In a practical application, the mobile platform may take the form of a skateboard or similar structure which is manually propelled and which is capable of supporting one or both feet of the individual on the outer exposed surface thereof.

Accordingly, the mobile platform assembly of the present invention includes a wheel assembly rotationally connected to the platform and disposed in engaging relation to the supporting surface over which the platform travels. In addition, the wheel assembly includes at least one, but more practically in at least some embodiments, a plurality of wheels each having a spherical configuration. The one or more spherical wheels are movably connected to the platform through a cooperatively structured mounting assembly and bearing assembly associated with each of the spherical wheels. As set forth in greater detail hereinafter, the bearing assembly associated with each spherical wheel may comprise one of a plurality of different embodiments structured to movably interconnect it to the platform. Common to each of the different embodiments of the bearing assembly is the capability of facilitating a substantially universal, rotational movement of the corresponding spherical wheel relative to the platform, as the wheel engages and travels over the supporting surface. However, distinguishing structural features of the embodiments of the bearing provide for a substantially universal, rotational range of motion of the corresponding wheel in a substantially free or unrestricted manner or about more specifically defined axes.

Additional structural and operative features associated with the various preferred embodiments of the present invention include a mounting assembly associated with each of the plurality of wheels. The mounting assembly comprises at least one mounting or retaining plate preferably having an annular configuration and a central aperture cooperatively dimensioned and configured to facilitate receipt of a corresponding one of the spherical wheels there through. Further, each of the spherical wheels is cooperatively dimensioned and disposed relative to the central aperture to concurrently extend or protrude outwardly from opposite faces or surfaces of the mobile platform. This protruding disposition of the spherical wheel significantly enhances the versatility of the mobile platform by allowing the use thereof while the platform is in either one of at least two operative positions of the platform.

Each of the two operative positions are defined by a different one of the opposite surfaces of the platform being disposed in an outer or exposed orientation and in confronting, engaging and supporting relation to the individual riding the mobile platform. More specifically, due to the fact that each of the spherical wheels extend concurrently outward from each of the opposite surfaces of the platform a sufficient distance to engage the supporting surface over which the platform travels, the user of the mobile platform can choose to "ride" or be supported on different ones of the opposite surfaces, dependent on which of the two operative positions the platform is disposed. To facilitate the versatility of operating and/or using the mobile platform in this manner, the configuration of the platform may have to be modified and/or customized in order to permit the orientation of the platform in either of the at least operative positions.

Each bearing assembly associated with a different one of the spherical wheels is movably connected to and/or retained by a corresponding one of the mounting or retaining plates defining the mounting assembly. As such, the mounting or retaining plates associated with each spherical wheel may be cooperatively disposed and structured with the corresponding bearing assembly for that wheel and include a bearing a race therein. Accordingly, the bearing assembly associated with each spherical wheel is disposed in movable, retaining engagement with the exterior surface of the corresponding wheel, while being movable within or along a corresponding retaining or mounting plate disposed to interconnect the corresponding bearing assembly and the spherical wheel to the platform.

Therefore, one preferred embodiment of the bearing assembly includes a plurality of at least two bearing sections each connected to a common mounting assembly and disposed in spaced relation to one another. The spacing between the two bearing sections is sufficient to provide a sufficient force on the exterior surface of the corresponding wheel to retain it on the platform during its substantially universal rotational movement relative to the platform. More specifically, the two sections of a common bearing assembly for each spherical wheel are preferably disposed on opposite sides of an imaginary "great circle" generated on the exterior surface of the spherical wheel. For purposes of clarity, an accepted definition of the term "great circle" is a circle, in this case imaginary, generated on the surface of a sphere that divides that sphere equally into two hemispheres. Accordingly, the "great circle" may also be accurately defined as the intersection of the surface of a sphere with a plane passing through the center of that sphere.

Therefore, the distance of the bearing sections from the great circle may vary but should be sufficient to provide adequate retaining force to facilitate maintaining the wheel in movably connected and supporting relation to the platform. In one preferred embodiment of the bearing assembly each spherical wheel is allowed to "freely" rotate through a substantially universal range of motion. This is due to the fact that the spherical wheel is only interconnected to the support platform through the provision of the spaced apart sections of the corresponding bearing assembly. Further these two retaining bearing sections extend in surrounding relation to and in continuous movable engagement with the exterior surface of the spherical wheel, while the bearing sections are movably retained by the corresponding mounting plate(s).

In contrast, another preferred embodiment of the bearing assembly includes an axle extending through the center of a corresponding one of the spherical wheels and being of sufficient dimension to at least partially extend outwardly from the opposite sides of the sphere. When operatively connected in the manner set forth in greater detail hereinafter, this centrally disposed axle will define a first rotational axis of the wheel. Moreover, this preferred embodiment of the bearing assembly includes a first bearing portion and a second bearing portion. The first bearing portion rotationally interconnects the centrally deposed axle to the spherical wheel. The second portion of the bearing assembly preferably includes two bearing sections at least generally similar to the two bearing sections described above. Moreover, when operatively assembled, the two bearing sections of this additional embodiment of the bearing assembly are disposed in continuously surrounding relation to the exterior surface of the wheel and in engaging relation therewith. Also these two bearing sections are connected to one another and to opposite end portions of the centrally disposed axle.

Accordingly, the axle extending through the spherical wheel and the wheel itself is rotational with the second bearing portion, comprising the two bearing sections, relative to the mounting assembly connected to the bearing assembly. Therefore, the first bearing portion of each bearing assembly, associated with each spherical wheel, rotationally interconnects the axle to the spherical wheel. The second bearing portion of each bearing assembly associated, associated with each spherical wheel, interconnects the spherical wheel, through fixed attachment to the axle, to the platform and/or more specifically, to a corresponding mounting assembly. As a result, this preferred embodiment of the bearing assembly defines more specific rotational characteristics by affiliating each spherical wheel to rotate about a first rotational axis at least partially defined by the centrally disposed axle and concurrently about a second rotational axis which is transverse or perpendicular to the second rotational axis.

Yet another preferred embodiment of the present invention is directed to a mobile platform assembly varying at least somewhat in structure and operation from the preferred embodiments as set forth above. As such, this additional preferred embodiment may be structured to operate and function more like a shoe skate rather than a skateboard. However, as will be more evident from a detailed description of this additional preferred embodiment, the operational characteristics of this "skate-type" embodiment may be substantially similar to the "skateboard" embodiment described above.

Accordingly, this additional preferred embodiment includes a base comprising a wheel assembly including at least one, but more practically a plurality of wheels connected to the base and disposed in spaced relation to one another. Each of a plurality of preferably two wheels of the wheel assembly is located adjacent to opposite ends of the base. In addition, each wheel has a spherical configuration and is movably interconnected to the base by means of a bearing assembly. As set forth with the other preferred embodiments described herein, the bearing assembly may be defined by different structures and may include various structural modifications while still facilitating the intended movement or travel of the base as the wheel assembly engages a supporting surface over which the base travels.

More specifically, the bearing assembly associated with each of the spherical wheels is structured to movably interconnect the base and the wheel in a manner which facilitates a substantially universal, rotational movement of the corresponding wheel relative to the base, as it travels over the supporting surface. Additional structural features of this additional skate-type embodiment include the provision of a support platform moveably connected to the base and disposed generally intermediate the ends of the base and between the two spherical wheels located adjacent opposite ends of the base. In addition, the support platform is disposed and structured to facilitate supporting engagement with preferably one foot of the individual. In this skate-type of structural configuration, a single foot of the user may be supported on the support platform and movable therewith relative to the base. However, structural variations of this preferred embodiment may include an enlarged or otherwise modified dimension and configuration of the support platform and/or the base in order to possibly accommodate at least the temporary engagement and support of both feet of the user.

Due to the movable interconnection of the support platform with the base, the support platform may be selectively disposable in and out of confronting relation to the supporting surface over which the base is traveling. Further, such selective disposition of the support platform relative to the supporting surface is accomplished by a predetermined manipulation of the at least one foot of the individual engaged by and supported on the support platform. This confronting relation may be more specifically described as a frictional engagement of the support platform with the supporting surface over which the base travels. Accordingly, at least one embodiment of the support platform comprises at least one contact portion disposed in outwardly extending relation to an under surface of the support platform. Moreover, the at least one contact portion may preferably, but not exclusively, be located adjacent one end of the support platform. As a result, the pivotal or at least partially rotational movement of the support platform, due to predetermined manipulation of the corresponding foot of the individual, will force the one contact portion into frictional engagement with the supporting surface over which the base is traveling.

Additional structural and operational features associated with this skate-type embodiment include the support platform and the one contact portion being cooperatively structured with the base to readily accomplish a selective disposition of the contact portion into a "braking orientation" relative to the supporting surface upon predetermined movement of the user's foot. This in turn will serve to affect the velocity of the base, by slowing or braking it, as it travels over the supporting surface due to such frictional engagement. In contrast, the velocity of the base relative to the supporting surface may be further influenced by disposing the support platform and the contact portion in what may be referred to as an "accelerating orientation". The accelerating orientation is accomplished by the pivotal or at least partial rotational disposition of the support platform resulting in the one contact portion frictionally engaging the supporting surface. The accelerating orientation allows the user supported on the base to effectively "push-off" thereby serving to increase and/or at least maintain the velocity of the base. When the foot of the individual is disposed in the aforementioned predetermined orientation necessary to accomplish the accelerating orientation of the support platform, other portions of the user's body may also be oriented to further facilitate the "push-off" function as the one contact portion frictionally engages the supporting surface.

Therefore, the various preferred embodiments of the mobile platform assembly, including what may be referred to in general, but not limiting, terms as a "skateboard" embodiment and a "skate-type" embodiment will facilitate the use thereof in a manner which overcomes certain disadvantages and problems of known mobile platforms by increasing the maneuverability thereof. As more fully described hereinafter, such increased maneuverability is at least partially attributable to the ability of each spherical wheel, defining the corresponding wheel assemblies, being capable of moving relative to the platform or base through a substantially universal, rotational range of motion independently of one another. Further, in the skateboard embodiment, the platform may vary in size and shape and still be capable of being disposed in either of at least two operative positions respectively defined by different ones of the opposite platform surfaces being disposed in confronting, supporting relation to an individual rider. As such, an individual may effectively orient the platform between the first and second operative position even during travel of the platform especially by individuals which are considered highly skilled in the operation or use of the platform, such as but not limited to, skateboard type assemblies.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
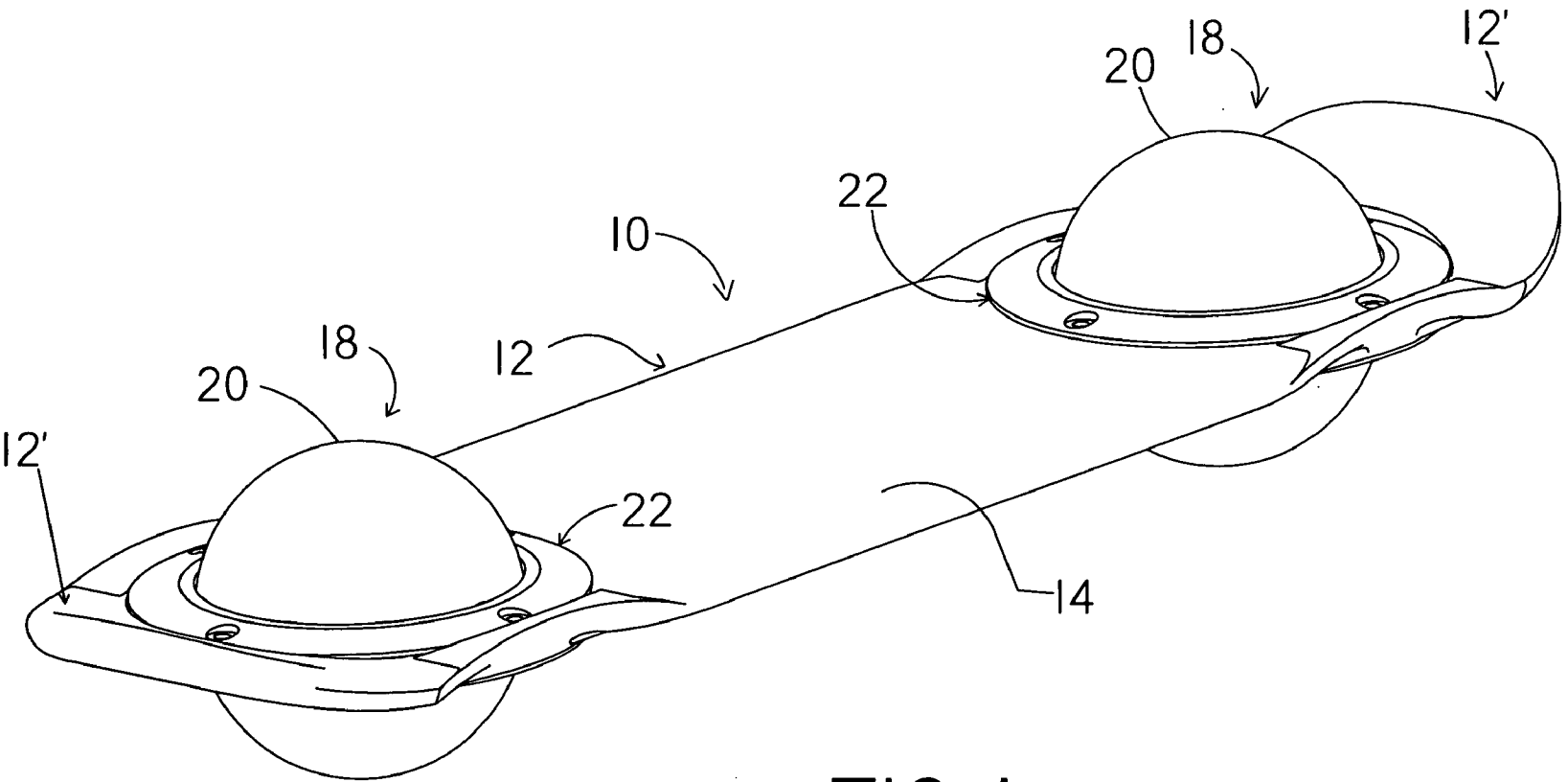
FIG. 1 is a perspective view of the mobile platform assembly of the present invention in an assembled form.

As shown in the accompanying Figures, the present invention is directed to an assembly generally indicated as 10 which is structured to transport or otherwise movably support an individual rider over a variety of supporting surfaces. The platform 12 may be in the form of a skateboard or other mobile device which is typically, but not exclusively, manually propelled. However, it is emphasized that the platform 12 of the assembly 10 may be structured, dimensioned and configured to define a number of different types of support platform other than a skateboard, such as a base of a scooter, a roller skate, shoe skate, etc.

Accordingly, the assembly 10 includes the platform 12, including an outer, exposed surface 14 and an undersurface 16. In conventional fashion, the outer, exposed surface 14 is typically disposed in supporting, generally confronting engagement or relation to the individual rider. As such, the outer supporting surface is of a sufficient dimension and configuration to receive and support one foot or both feet of the rider thereon. In addition, the mobile assembly 10 includes a wheel assembly 18 which includes at least one but more practically a plurality of wheels 20 one or more of which comprises a spherical configuration. Each of the one or more wheels 20 are movably connected to the platform 12 by a mounting assembly generally indicated as 22 and one of a plurality of embodiments of a bearing assembly generally indicated as 24, 24', 24", etc. as explained in greater detail hereinafter.

Figure 2:
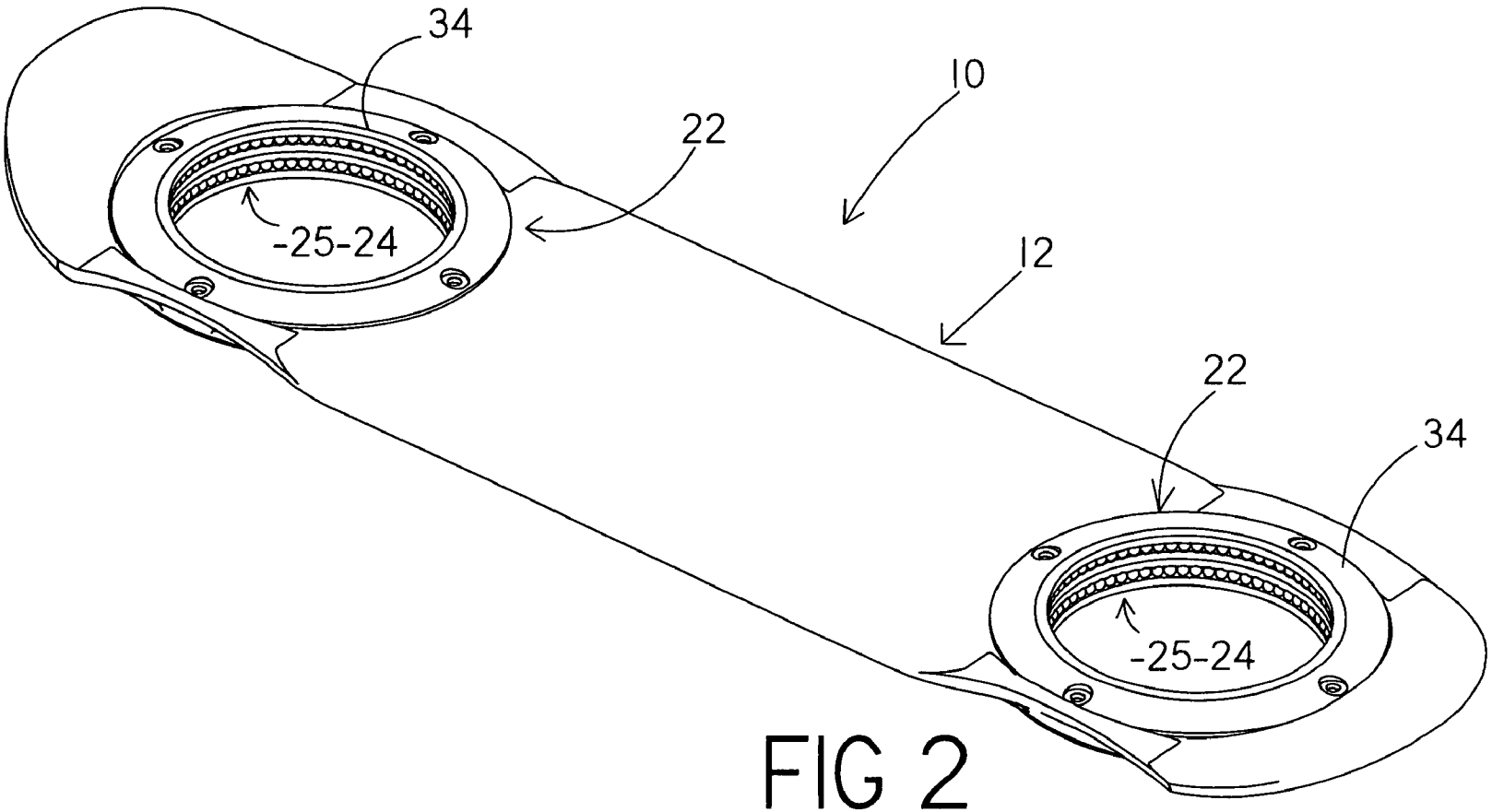
FIG. 2 is a perspective view of the embodiment of FIG. 1 absent a wheel assembly.
Figure 3:
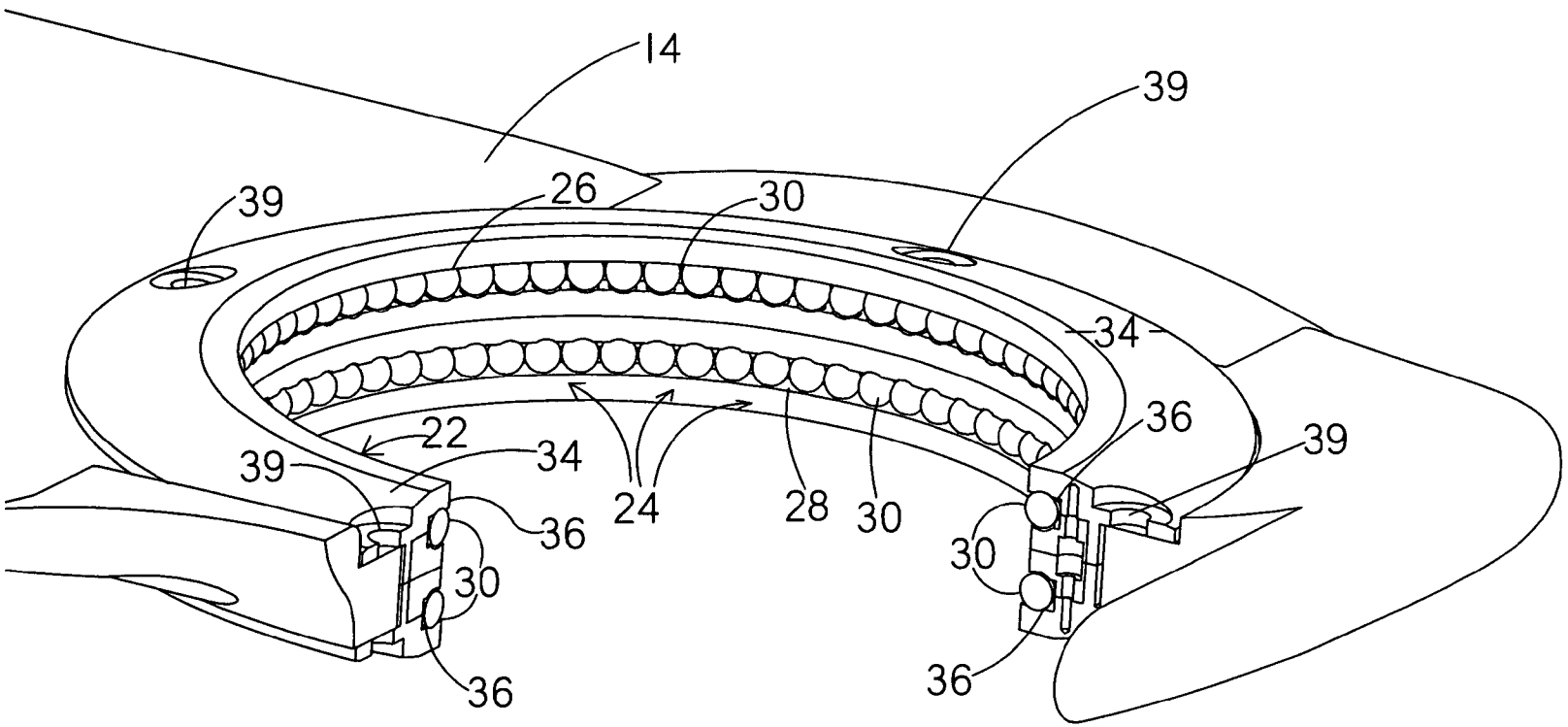
FIG. 3 is a perspective view in partial cutaway of one preferred embodiment of a bearing assembly associated with the embodiment of FIG. 2.
Figure 4:
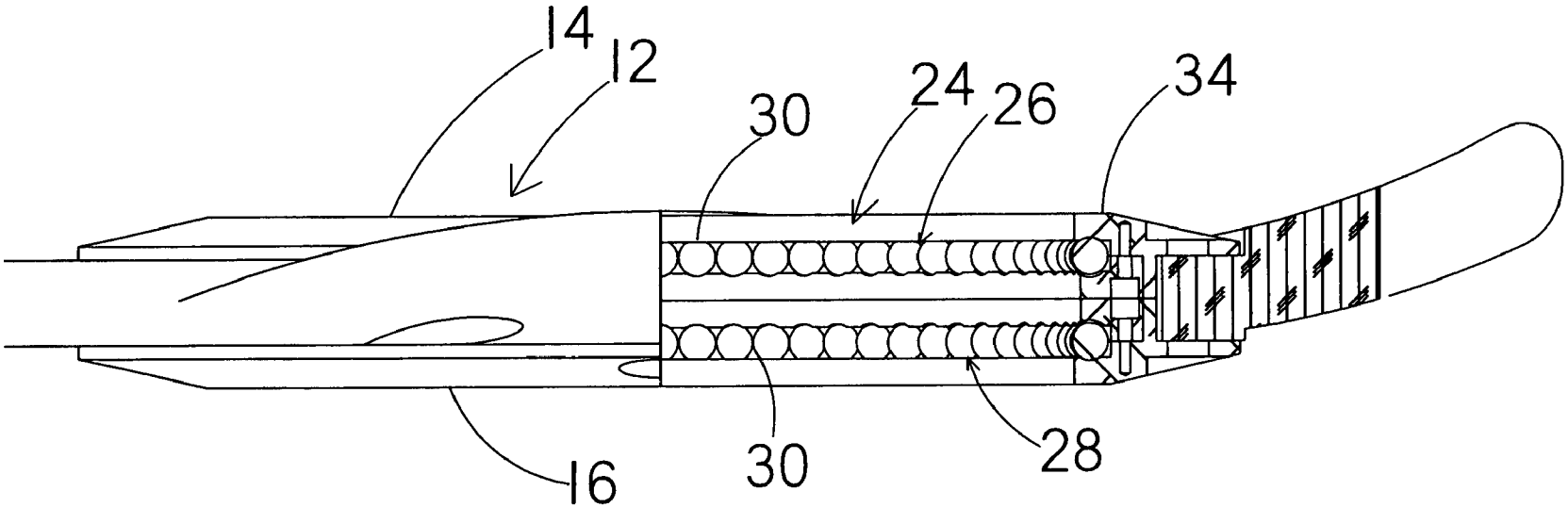
FIG. 4 is a perspective view in partial cutaway of the bearing assembly of the embodiment of FIGS. 2 and 3.

With primary reference to FIGS. 2-4, one preferred embodiment of the bearing assembly 24 comprises at least two bearing sections 26 and 28 each of which includes a plurality of bearings or bearing members 30 disposed in adjacent and/or contiguous relation to one another. Each of the bearing members 30 of each of the sections 26 and 28 extend continuously along the annular or circular length of a corresponding mounting assembly 22. As such, the plurality of bearings 30 are collectively disposed in continuously surrounding and movably engaging relation with a corresponding one of the spherical wheels 20, wherein the wheel is disposed within the central aperture 25 of the respective mounting assembly 22.

Further, the operative placement of the two bearing sections 26 and 28 and the corresponding plurality of bearings 30 associated with each of these sections, are disposed to movably engage and retain the spherical wheel 20 within the central aperture 25. The cooperative placement and structuring of each of the wheels 20 with the corresponding mounting assemblies 22 and bearing assemblies 24 will facilitate that each of the spherical wheels 20 will be maintained in the operative position represented in FIG. 1 relative to the platform 12. Also, each of the wheels 20 will extend or protrude outwardly from the opposite surfaces 14 and 16 of the platform 12.

In addition, the dimension of each of the wheels 20 is such that the portion thereof protruding from each of the opposite surfaces 14 and 16 can be disposed in movable, supporting engagement with a supporting surface over which the platform 12 travels. Therefore, the platform may be selectively disposed in either of two operative positions. Each of the two operative positions is defined by a different one of the opposite faces or surfaces 14 or 16 being disposed in the outer, exposed orientation and in confronting, supporting, engaging relation to the individual rider. Therefore, those individuals who are extremely skilled or practiced in the use of a skateboard or other type platform 12, may effectively "flip" or turn and thereby reverse the position of the opposite surfaces 14 and 16, during various maneuvers by the skilled, individual rider. In addition, the two end portions 12' of the platform 12 may have their configurations altered so as not to extend outwardly from the surface 14, thereby additionally facilitating the placement of the platform 12 in either of the two operative positions.

Further with regard to the embodiments of FIGS. 2-4, each of the mounting assemblies 22 includes at least one mounting or retaining plate 34 preferably having an annular configuration. Moreover, the central aperture 25 extends through the mounting plate and is of sufficient size and structure to retain one spherical wheel 20 therein as represented in FIG. 1. The structural features of the embodiments of FIGS. 2-4 represent the mounting assembly 22 having a singular mounting or retaining plate 34. Each of the two sections 26 and 28 of each bearing assembly 24 rides within interior channels or portions 36, which serve as bearing races for the plurality of bearings 30 associated with each of the two bearing sections 26 and 28. As a result, the plurality of bearings 30 associated with each bearing section 26 and 28 are concurrently disposed in movable, retaining engagement with the exterior surface of the corresponding spherical wheel 20 when the wheels 20 are disposed in the operative position of FIG. 1.

An intended freedom of rotation of the spherical wheel 20 is accomplished as it moves through a substantially universal, rotational range of motion. Such freedom of rotation is at least partially accomplished, by the two bearing sections 26 and 28 being disposed in predetermined spaced relation to one another as they retain and engage the exterior surface of the wheel 20 and are movably disposed within separate ones of the race bearings 36 of the mounting or retaining plate 34. The spacing between the two sections 26 and 28 may vary but should be sufficient to provide an adequate retaining force on the exterior surface of the spherical wheels 20 while allowing the aforementioned freedom of movement of the wheel throughout the substantially universal, rotational range of motion, as set forth above. Further, each of the bearing sections 26 and 28 and the bearing members 30 associated therewith are disposed to movably engage the exterior surface of the spherical wheel 20 about different hemispherical portions thereof.

More specifically, regardless of the rotational orientation of the spherical wheel 20, each of the bearing sections 26 and 28 will be disposed on opposite sides of an imaginary "great circle" generated on the exterior surface of the spherical wheel 20. For purposes of clarity, the term "great circle" is defined as a circle, in this case imaginary, generated on the surface of a sphere that divides that the sphere equally into two hemispheres. Accordingly, the term "great circle" as used herein may also be accurately defined as the intersection of the surface of a sphere with a plane passing through the center of that sphere. As clearly represented in FIGS. 3 and 4, when the spherical wheels 20 are connected to the platform as in FIG. 1, each of the bearing sections 26 and 28 are disposed an equally spaced distance from an imaginary great circle generated on the outer spherical surface of a corresponding wheel 20. Moreover, the distance of each bearing section 26 and 28 from a corresponding imaginary great circle, as well as from one another, is sufficient to movably retain the corresponding wheel 20 in its intended position of FIG. 1, while an individual rider is supported on the platform 12.

Therefore, each of the wheels 20 is associated with a mounting plate 34 defining a corresponding mounting assembly 22. Each mounting plate 34 and the bearing assembly 24 associated therewith are cooperatively structured to movably interconnect corresponding ones of the wheels 20 through the platform 12 in a location which facilitates the travel of the platform 12 over a supporting surface while providing sufficient stability to the individual rider during the travel of the platform 12. In order to accomplish such versatility and stability, each of the mounting or retaining plates 20 have the aforementioned annular configuration such that outer peripheral portions thereof are fixedly secured to the platform 12 such as by appropriate connectors (not shown) passing through receiving portions 39 of the retaining or mounting plate 34 as represented. In addition, the bearing assembly 24 comprising the at least two bearing sections 26 and 28 extend about the inner peripheral portion of the annular retaining or mounting plate 34 so as to surround and at least partially define the inner peripheral portion of the central aperture 25. As such, the bearing members associate with each of the bearing sections 26 and 28, extend outwardly from the corresponding bearing race 36 into movable, retaining engagement with the exterior surface of the corresponding one wheel 20.

Figure 5:
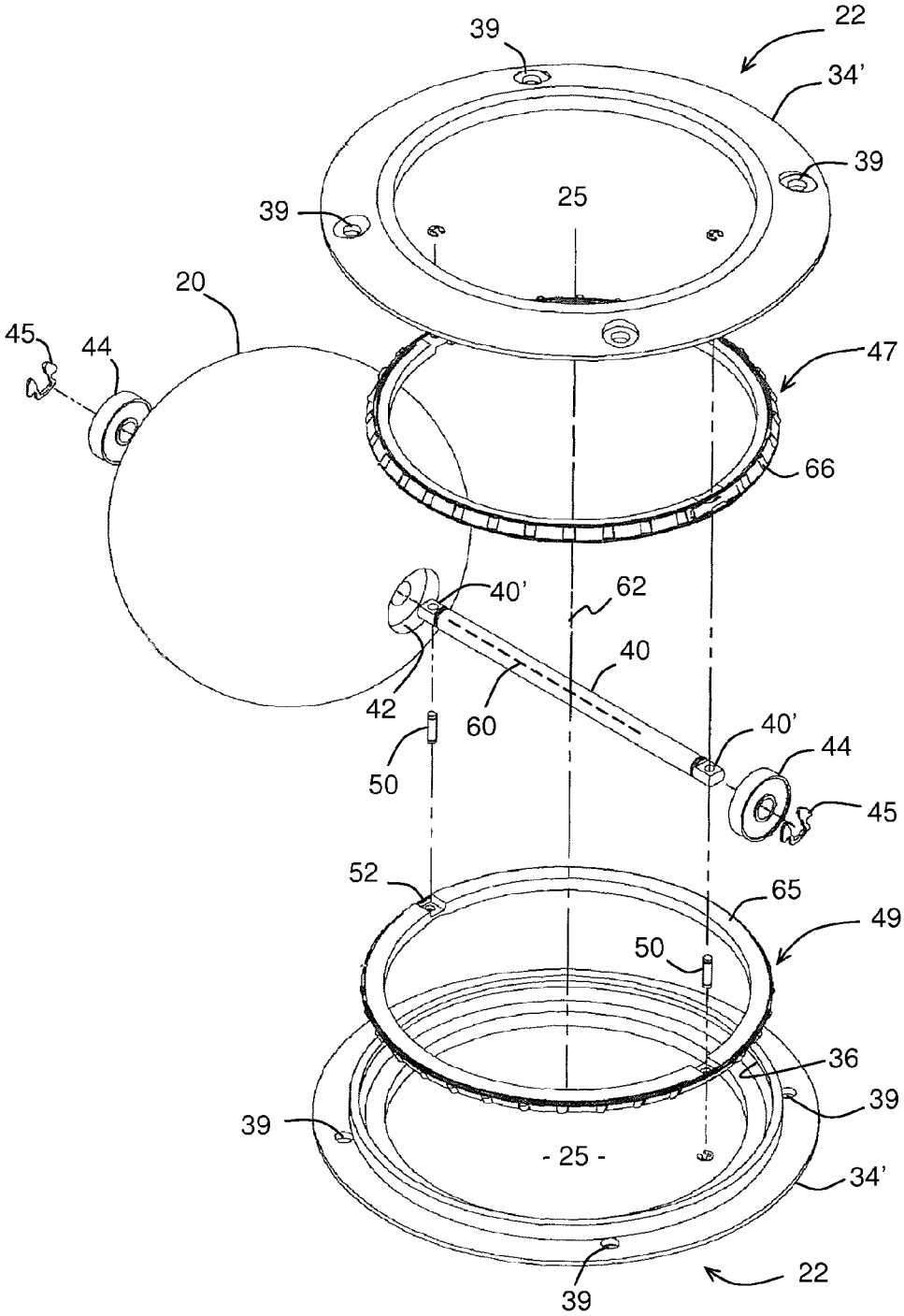
FIG. 5 is a perspective view in exploded form of yet another preferred embodiment of the present invention.
Figure 6:
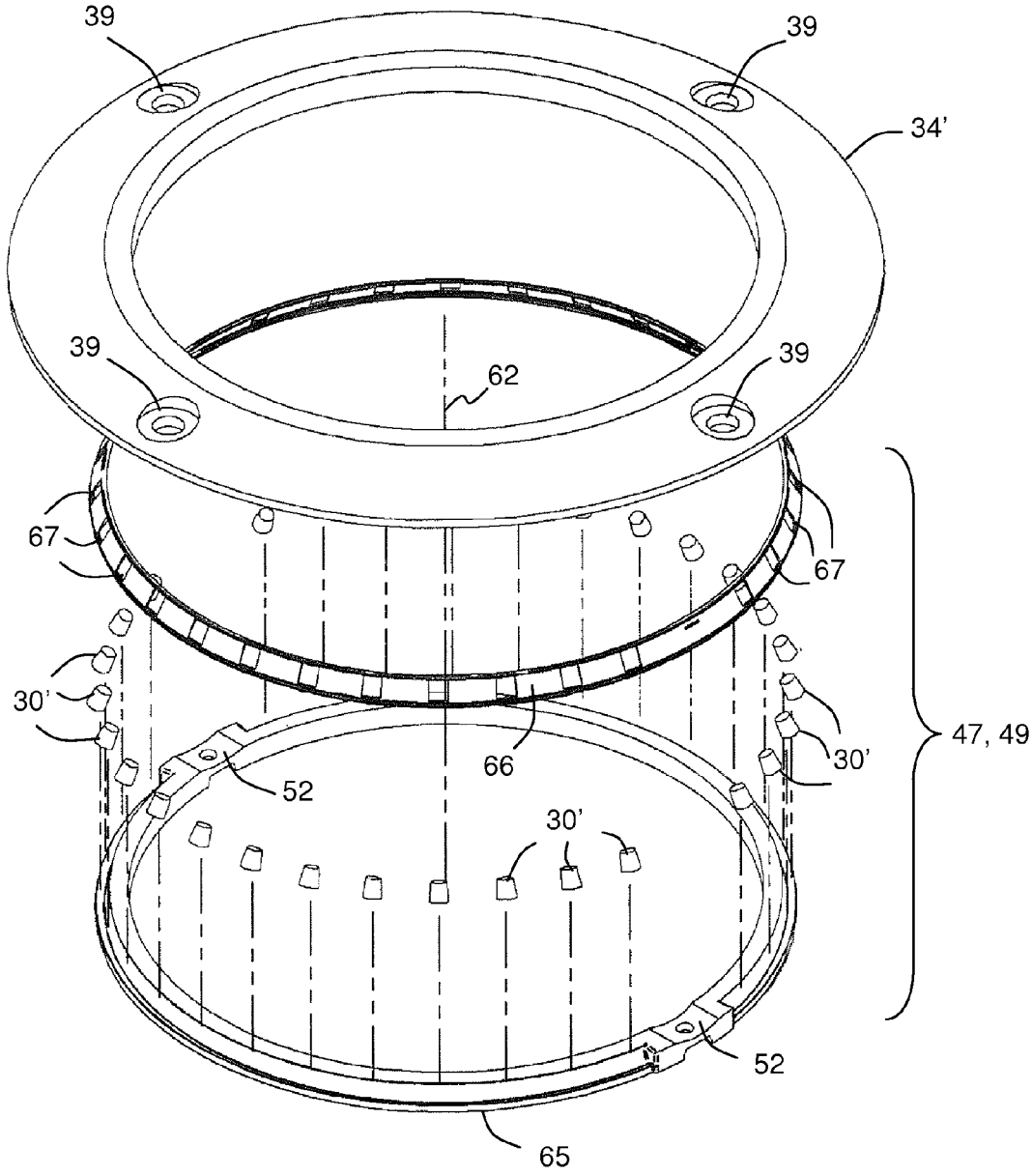
FIG. 6 is a perspective view in exploded form of details of the embodiment of FIG. 5.
Figure 7:
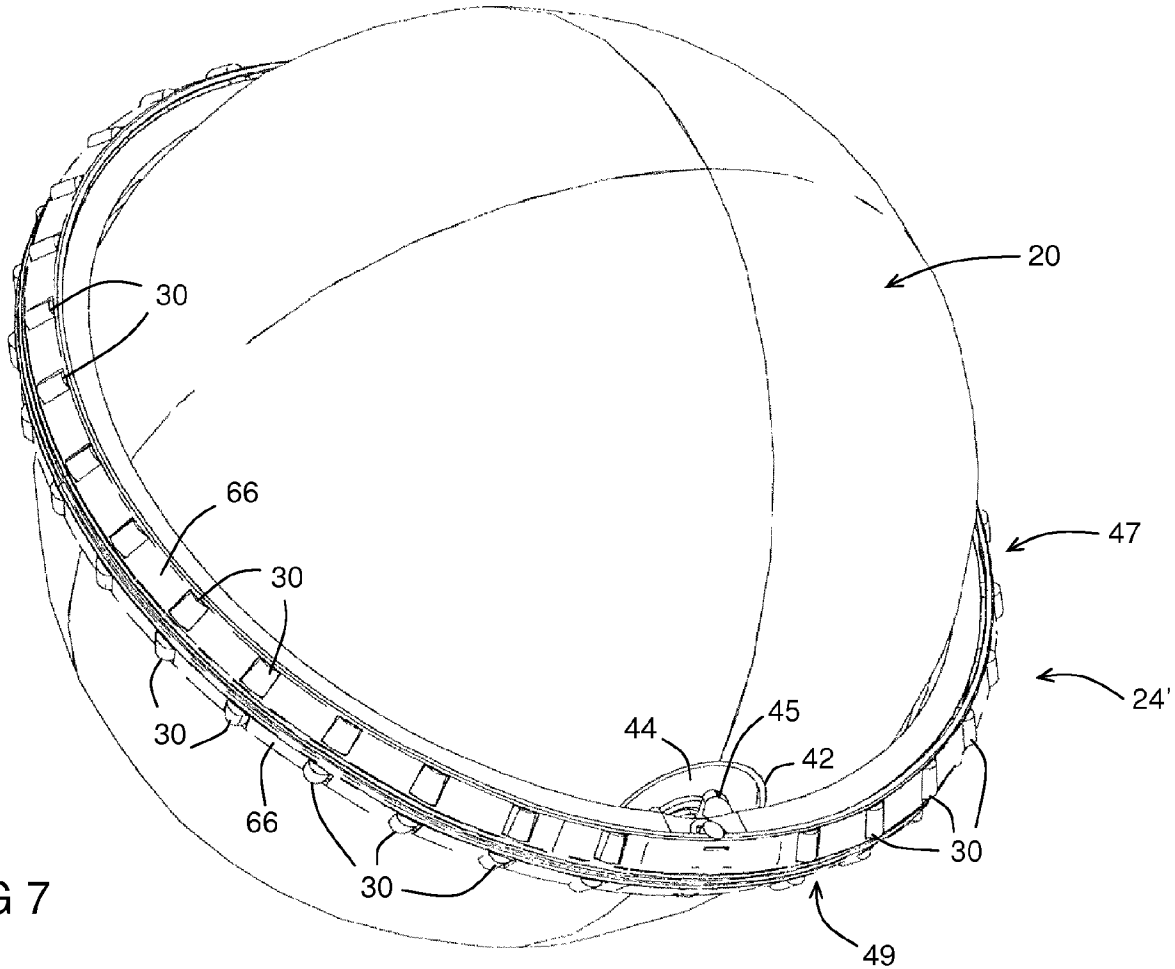
FIG. 7 is a perspective view of the embodiment of FIGS. 5 and 6 in a partially assembled form.

With primary reference to FIGS. 5-7, yet another preferred embodiment of the bearing assembly 24' is represented. More specifically, the bearing assembly 24 as represented in the embodiments of FIGS. 2-4 may be replaced by bearing assembly structure 24'. The differing bearing assemblies 24 and 24' are substantially equivalent in their operation and movement through a substantially universal, rotational range of motion, but differ structurally from one another. Accordingly, either of the bearing assemblies 24 and 24' may be utilized with the embodiment of the mobile platform assembly 10, as represented in FIG. 1.

More specifically, with regard to the embodiment of the bearing assembly 24' of FIGS. 5-7, an elongated axle 40 is disposed to extend through the center of the spherical wheel 20. Once the axle 40 is in the intended centrally extended position, the opposite ends 40' of the axle 40 are disposed to pass through the oppositely disposed recess portions 42 and extend outwardly from the exterior surface of the wheel 20. When so positioned, sealed or other appropriately structured bearings 44 are disposed within the recess portions 42 and mounted on the axle 40 adjacent to and inwardly from the ends 40'. Interconnecting disposition of the bearing members 44 between the axle 40 and the wheel 20 may be accomplished in any appropriate manner, such as by connecting clips 45. Further, the bearing assembly 24' of the embodiment of FIGS. 5-7 may be accurately described as including at least a first bearing portion, defined by the bearings 44 movably interconnecting the axle 40 and the wheel 20. A second bearing portion of the bearing assembly 24' comprises two bearing sections 47 and 49 fixedly connected to one another and fixedly connected to the ends 40' by appropriate connectors 50 passing through the ends 40' and into receiving portions 52 formed in each of the bearing sections 47 and 49.

Therefore, the bearing assembly 24' associated with each of the spherical wheels 20 includes a first bearing portion 44 and a second bearing portion defined by the two bearing sections 47 and 49. As set forth above, the first bearing portion 44 rotationally interconnects the spherical wheel 40 to the centrally disposed axle 40. Concurrently, the second bearing portion 47, 49, being fixedly connected to the axle 40 via its ends 40', will serve to movably and rotationally interconnect the corresponding wheels 20 to the mounting assembly 22 and thereby to the platform 12. As a result, the elongated axle 40 and its cooperative interconnection with the first bearing portion 44 serves to define a first rotational axis, schematically represented as 60 extending along the length of the axle 40. In addition, a second rotational axis, schematically represented as 62, passes through the center of the spherical wheel 20 in intersecting relation to the first rotational axis 60. The second rotational axis 62 is defined by a fixed connection of the first and second bearing sections 47 and 49 with one another and with the opposite ends 40' of the axle 40.

As represented in FIG. 7, an assembled view of the bearing assembly 24' includes the first and second bearing sections 47 and 49 connected to the ends 40' of the centrally disposed axle 40 and to one another. In use and with additional reference to FIG. 5, the first and second bearing sections 47 and 49, defining the aforementioned second bearing portion of bearing assembly 24', will rotate about the second longitudinal axis 62 within and relative to the mounting assembly 22 and the platform 12. Because of the fixed connection of the axle 40 with the first and second bearing 47 and 49 the wheel 20 will also rotate about the second axis of rotation 62 along with the first and second bearing sections 47 and 49. In addition, the wheel 20 will concurrently rotate about the first rotational axis 60 due to the axle 40 being rotationally interconnected to the corresponding wheel 20 by the bearings 44, disposed within recesses 42.

Additional structural features associated with the bearing assembly 24' are further represented in FIGS. 5-7. More specifically, the mounting assembly 22 in this embodiment may comprise two mounting or retaining plates 34' each having an annular configuration so as to define the central aperture 25 in which the spherical wheel 20 is operatively positioned as represented in FIG. 1. Also, each of the first and second bearing sections 47 and 49 are represented in detail in FIG. 6 and include a plurality of individual bearings or bearing members 30' movably captured or retained on the annular base portion 65 by means of a bearing cage 66. The bearing cage 66 includes a plurality of apertures formed therein through which the individual bearings 30' protrude when the first and second bearing sections 47 and 49 are operatively assembled as represented in FIG. 7. Accordingly, each of the bearings 30' are disposed in spaced relation to one another as they extend through the apertures 67 and rotate between the base portion 65 and the bearing cage 66. During such positioning, the protrusion of the bearing members 30' from the apertures 67 will allow the bearing members 30' to ride within the correspondingly disposed bearing race 36 of the corresponding mounting or retaining plate 34' as indicated in FIG. 5. Accordingly, each of the bearing sections 47 and 49 are capable of rotation about the second rotational axis 62 along with the centrally disposed axle 40 and a corresponding one of the wheels 20 due to an interconnection of the ends 40' of the axle 40 with the first and second bearing sections 47 and 49. As set forth above, the wheel 20 is also free to concurrently rotate about the first rotational axis 60, thereby facilitating movable connection of each of the wheels 20 to the platform 12 through the substantially universal, rotational range of motion, as also set forth above.

Yet additional structural features of the bearing assembly 24' of the embodiments of FIGS. 5-7 include the preferred configuration of each of the bearing members 30' into a generally tapered configuration, as represented. As such, the tapered configuration of each of the plurality of bearing members 30' may be more accurately and specifically defined as assuming a conical-frustum configuration, as represented.

Figure 8:
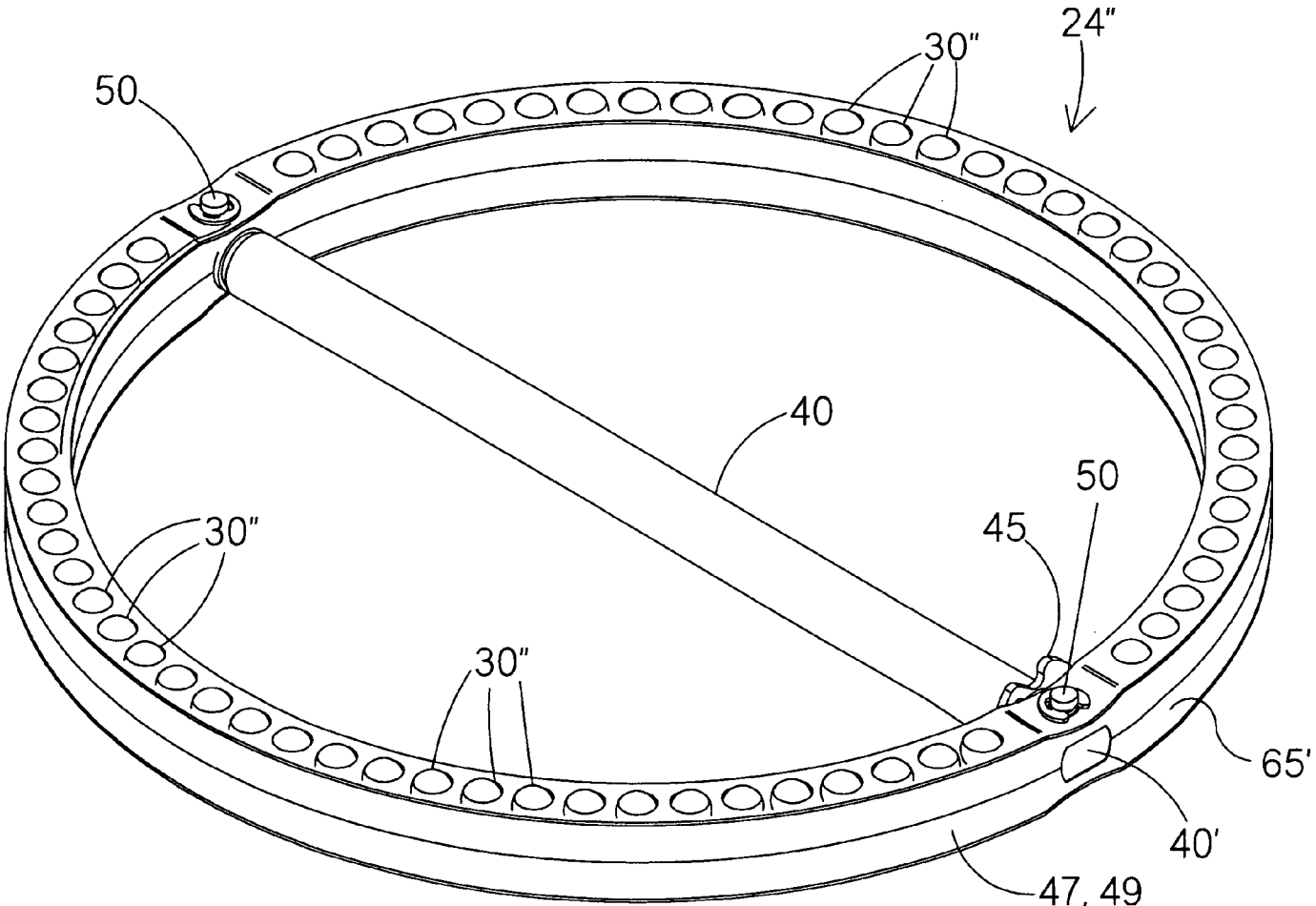
FIG. 8 is a perspective view of yet another embodiment of a bearing assembly which may be utilized with the embodiment of FIG. 1.
Figure 9:
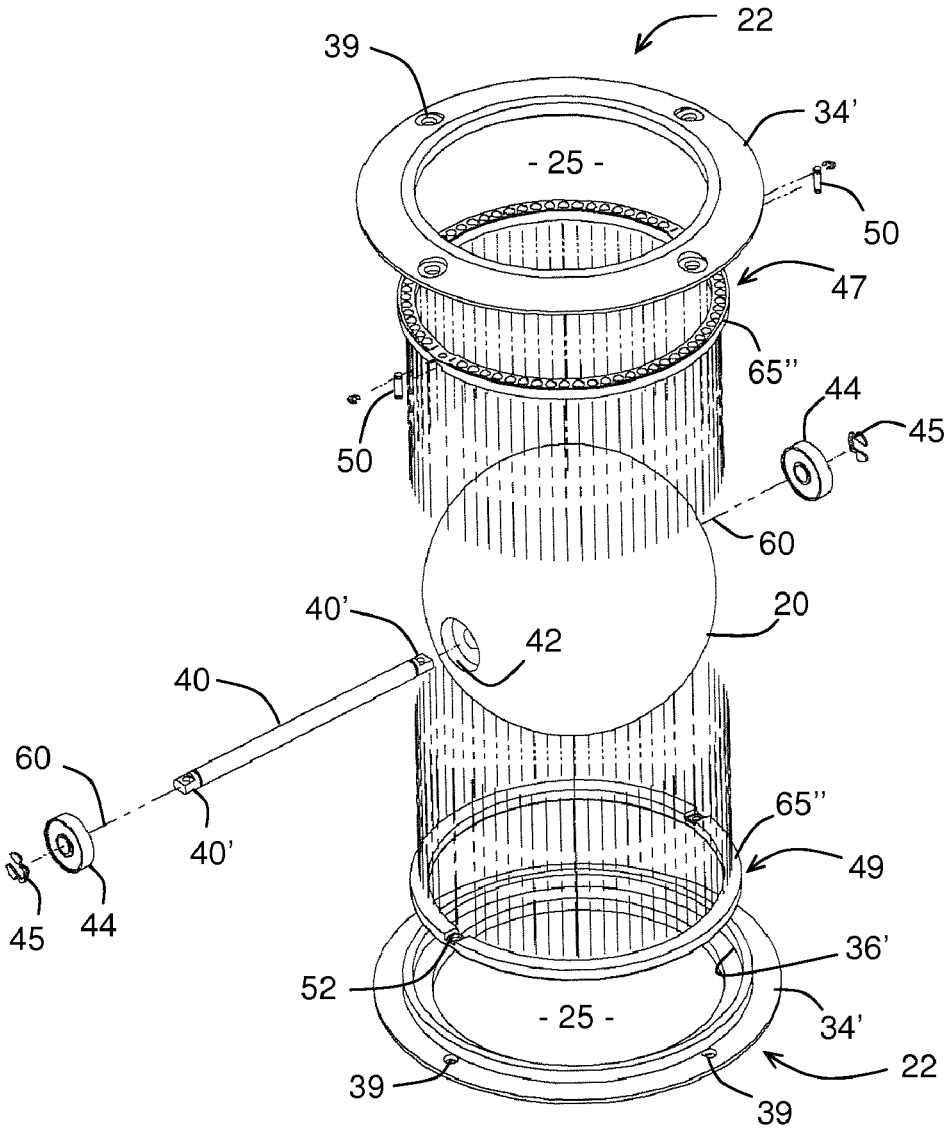
FIG. 9 is an exploded view of the bearing assembly of the embodiment of FIG. 8 and an associated one spherical wheel.
Figure 10:
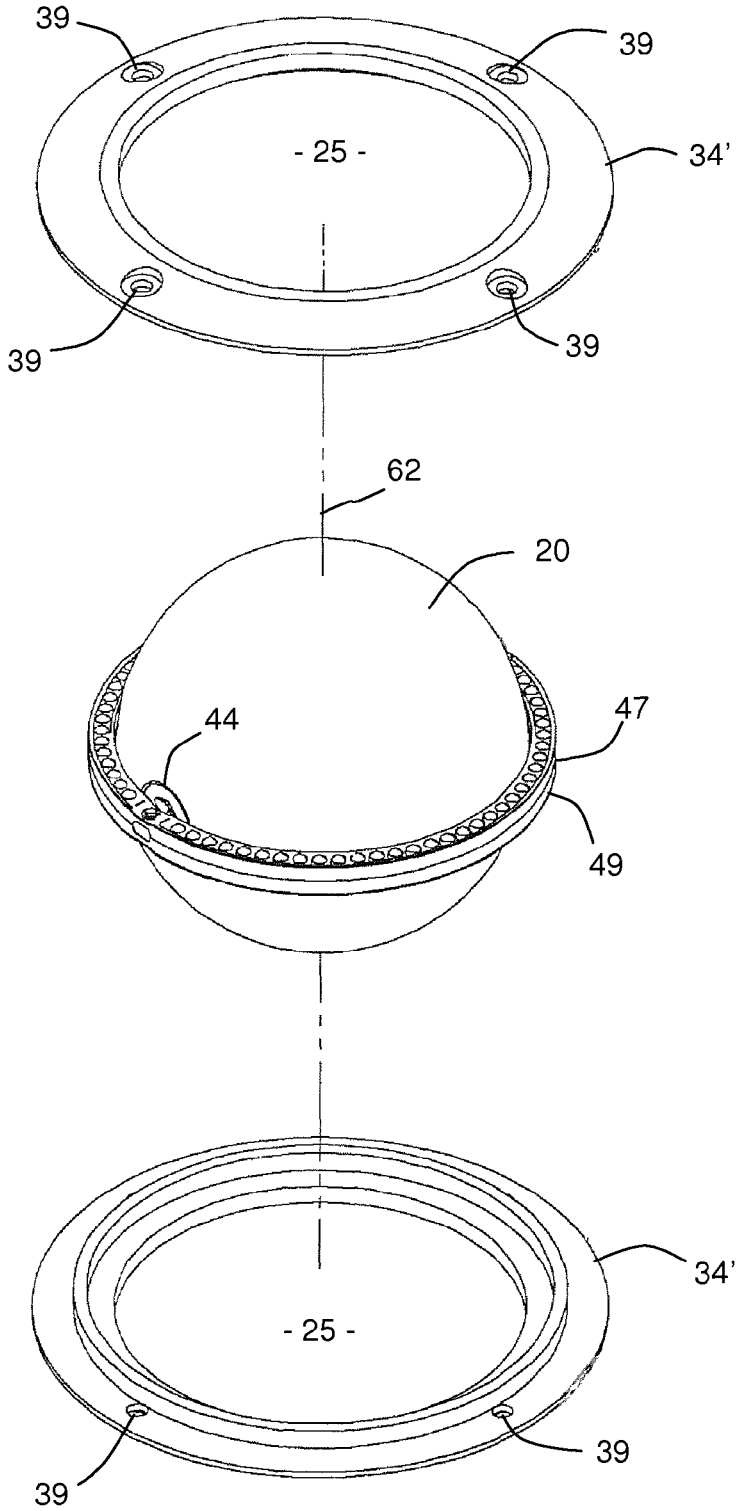
FIG. 10 is a perspective view in exploded form of a partially assembled embodiment of FIG. 9.
Figure 11:
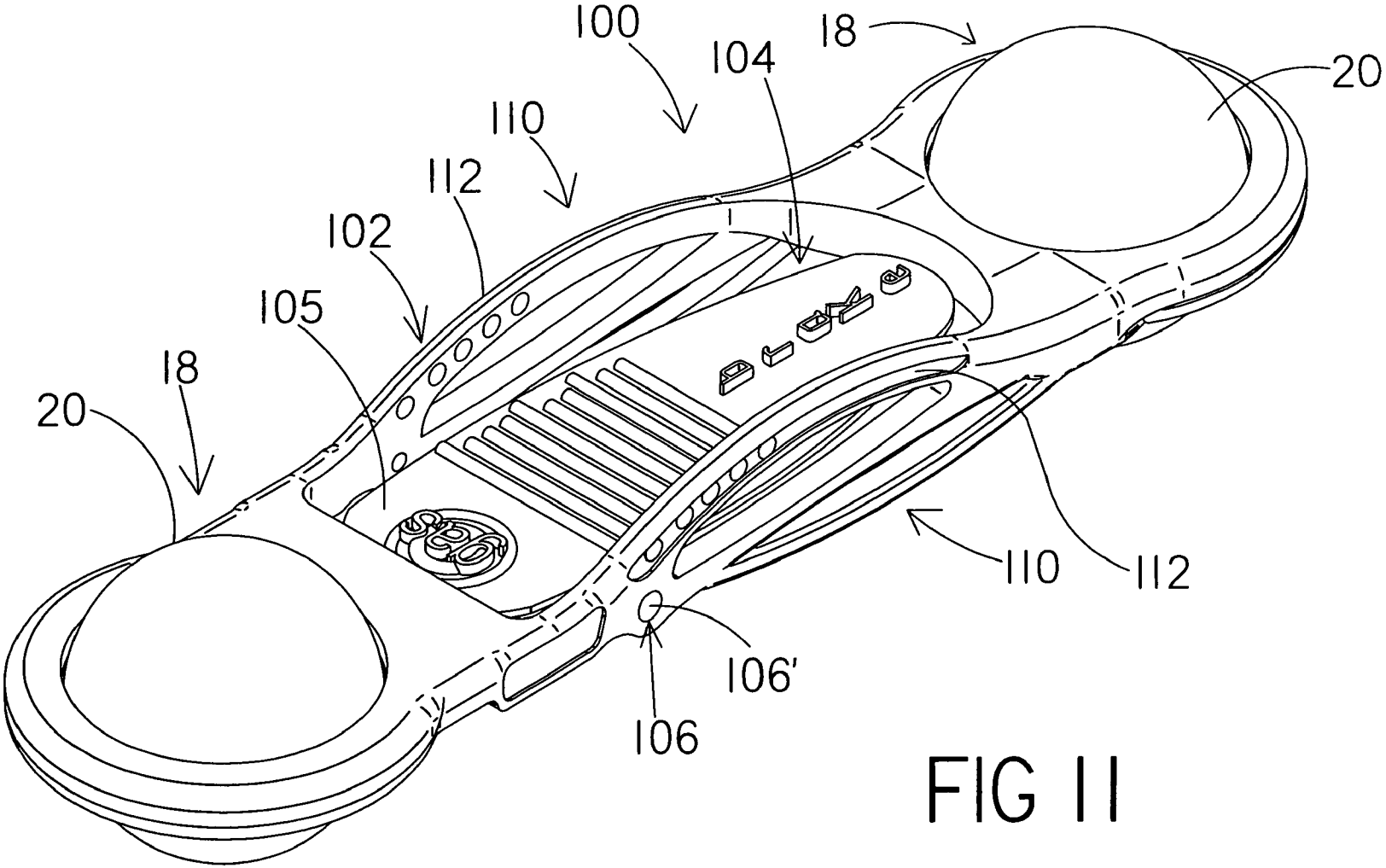
FIG. 11 is a top perspective view of yet another preferred embodiment of the mobile platform assembly of the present invention preferably, but not exclusively, in the form of a skate.
Figure 12:
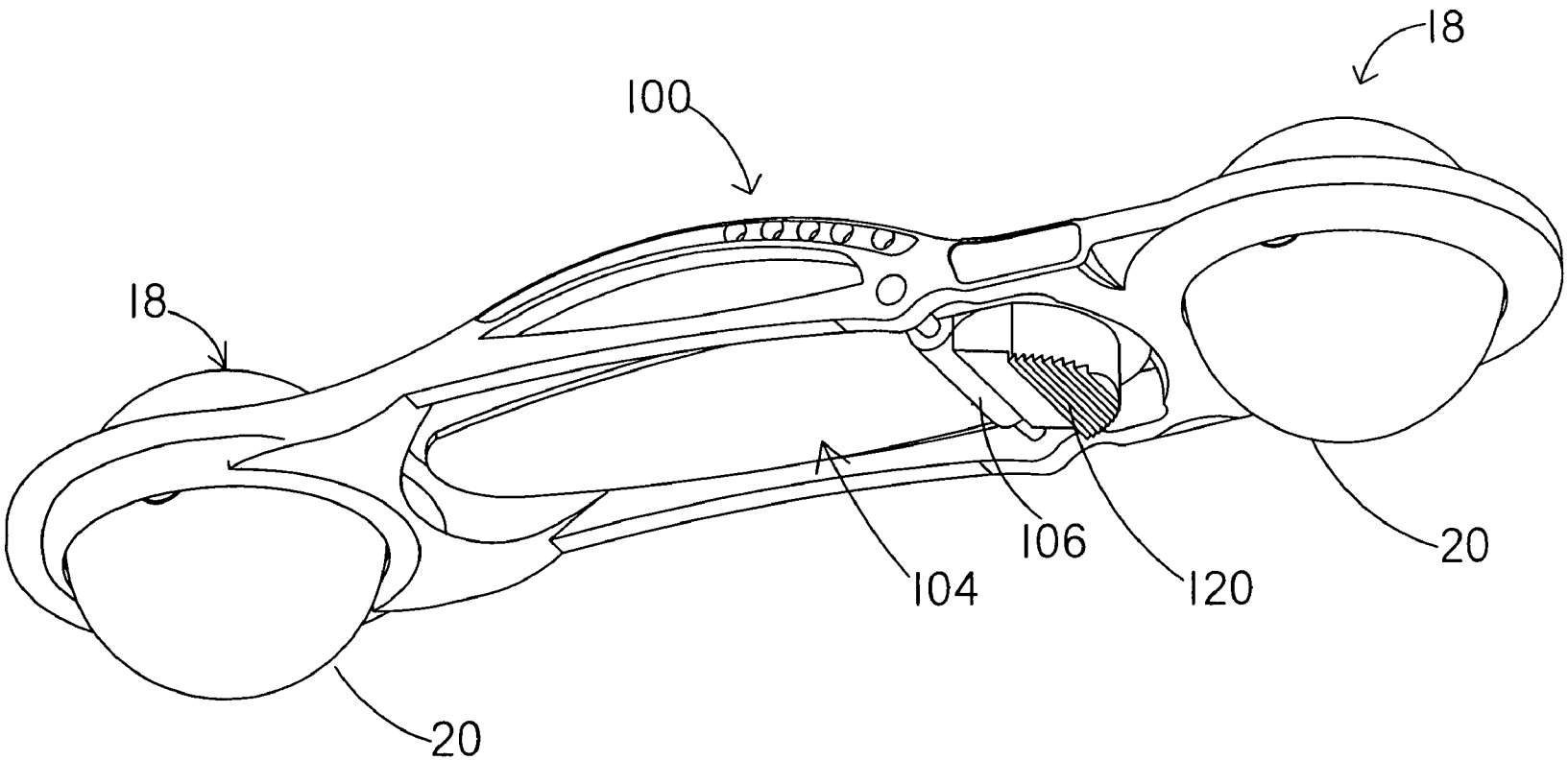
FIG. 12 is a bottom perspective view of the embodiment of FIG. 11.
Figure 13:
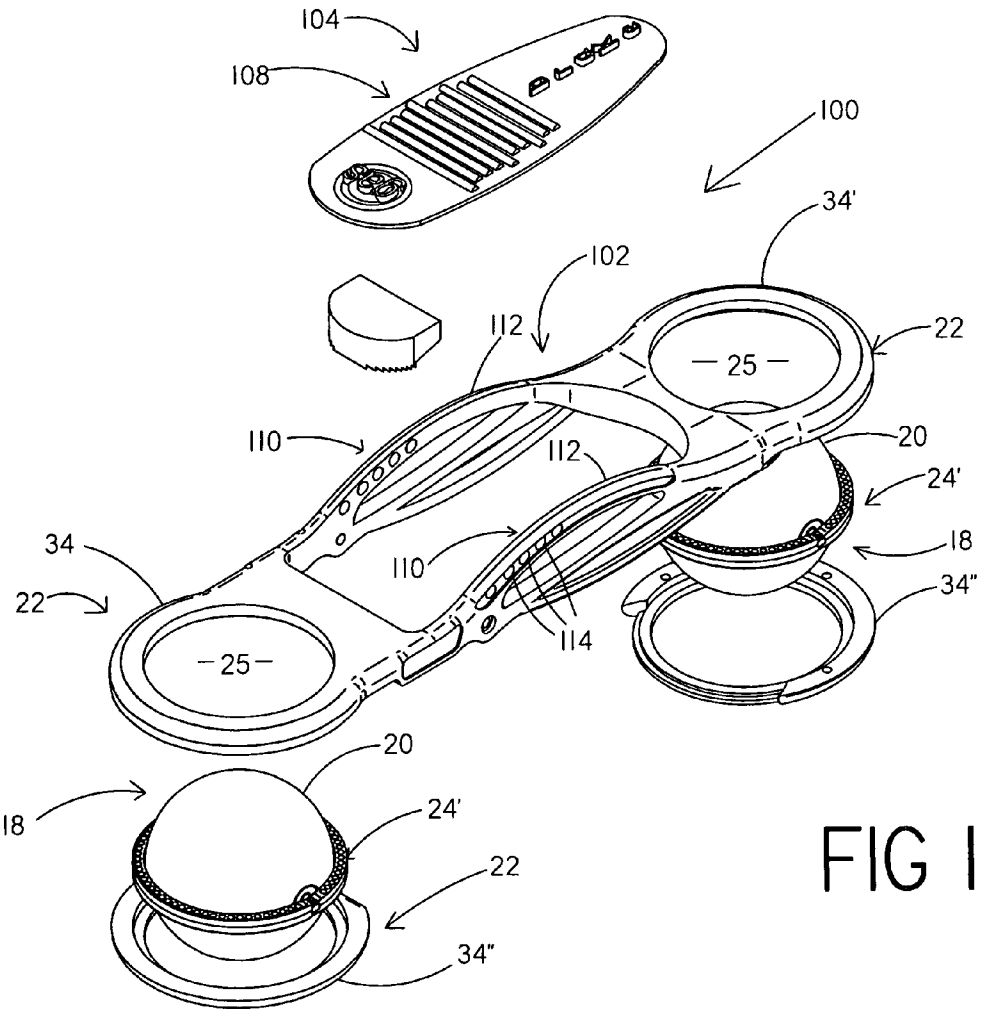
FIG. 13 is a perspective view in exploded form of the embodiment of FIGS. 11 and 12.

Yet another preferred embodiment of the bearing assembly is generally represented as 24' in FIGS. 8-10. The structural and operative features of this embodiment are similar in most aspects. However, the primary difference is the configuration of the plurality of bearing members 40" being spherical rather than tapered as in the embodiment of FIGS. 5-7. Accordingly, the first and second bearing sections 47 and 49 may be defined as a single housing or base member 65', as represented in FIG. 8 or may comprise two, separate base members 65" as represented in FIGS. 9 and 10. In either embodiment, the axle 40, once centrally disposed through the corresponding spherical wheel 20, is interconnected at its opposite ends 40' to rotate with the connected first and second bearing sections 47 and 49 relative to the mounting assembly 22. The mounting assembly 22 may also include two retaining or mounting plates 34' each having an appropriately disposed and configured bearing race 36 as indicated.

Therefore while the individual bearing members 30' and 30" may have different configurations, bearing members 30' and 30" are operable in the manner described to facilitate the rotation of corresponding ones of the wheels 20 about the second rotational axis 62. However, the tapered or conical/frustum bearings may have a physical and/or operative advantages by converting horizontal forces into axial forces as well as allowing the vertical forces exerted thereon to not bind the system but rather displace such vertical forces along the inner surfaces of the corresponding retaining or mounting plates 34'.

Figure 14:
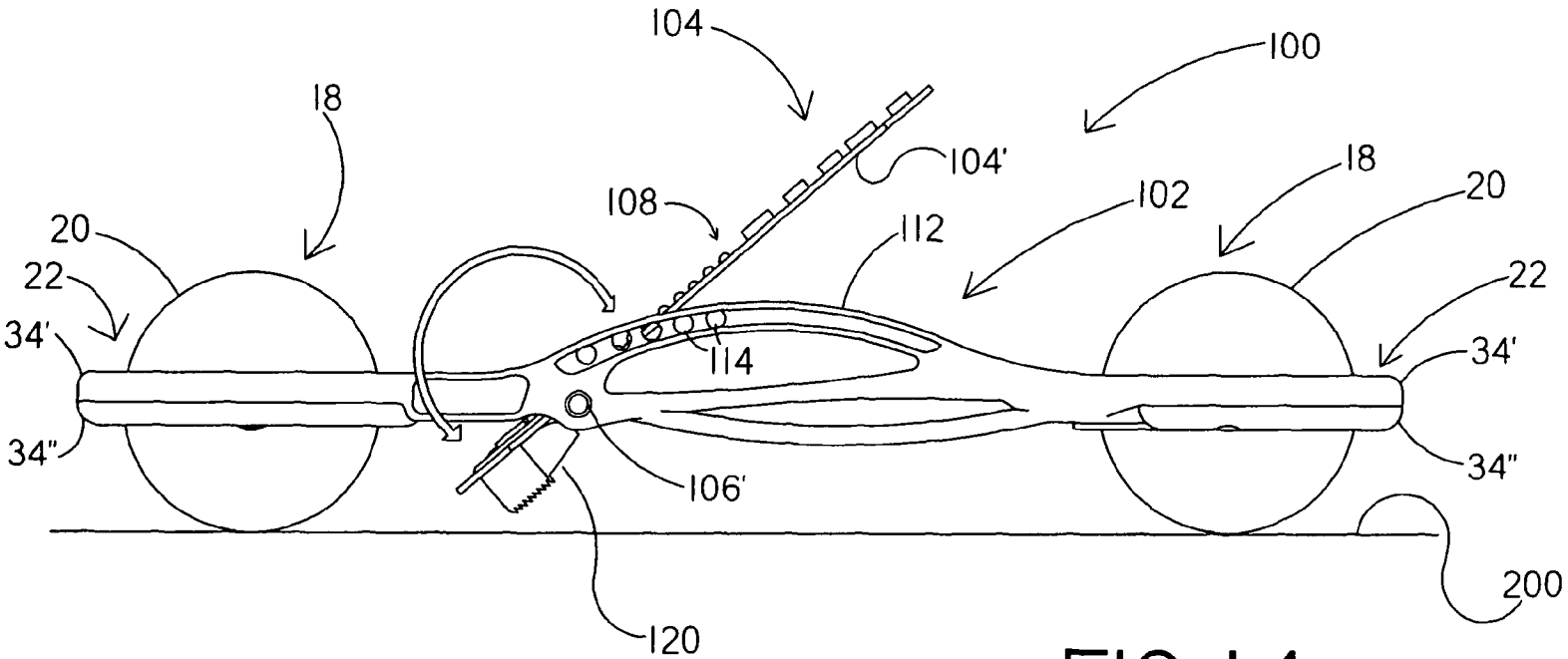
FIG. 14 is a side view of the embodiment of FIGS. 11-13 wherein a support platform is indicated as being movable relative to the remainder of the mobile platform assembly, into frictional engagement with a surface over which the mobile platform assembly travels.

With primary reference to FIGS. 11-14, yet another preferred embodiment of the mobile platform assembly is generally indicated as 100 and includes an elongated base generally indicated as 102. The base 102 includes a wheel assembly 18 including at least one, but more practically a plurality of preferably two wheels 20 each having a spherical configuration. Each of the wheels 20 associated with the base 102 may be considered an operational and structural equivalent to the spherical wheels 20 of the embodiments of FIGS. 1-10. As explained in greater detail hereinafter, the mounting assemblies 22 and corresponding ones of the bearing assemblies 24, 24', etc. described with reference to the embodiments of FIGS. 1-10 may be utilized to movably interconnect each of the spherical wheels 20 to the base 102. As such, each of the wheels 20 travels through a substantially universal, rotational movement or range of motion relative to the base 102 as they engage a supporting surface 200 over which the base 102 travels, as represented in FIG. 14.

The base 102, while having similar operational and performance characteristics of the platform 12, is structurally distinguishable at least to the extent of defining what may be generally referred to as a "skate-type" structure as versus what more closely resembles a "skateboard" structure as in the embodiments of FIGS. 1-10. However, it is emphasized that in embodiments of FIGS. 1-10 as well as the embodiments of FIGS. 11-14, the dimensions, configurations and structures of the platform 12 and/or base 102 can be modified from that specifically represented while still being included in the spirit and scope of the present invention.

Accordingly, the base 102 is dimensioned and configured to engage and support preferably a single foot of the individual rider or user. As such, the mobile platform 100 in the aforementioned skate-type configuration includes a support platform generally indicated as 104. Moreover, the support platform 104 is movably and more specifically pivotally or at least partially rotationally connected to the base 102 by means of a connecting rod or shaft 106 extending transversely to the base 102. The connecting rod 106 has its opposite ends 106' connected to opposite, lateral side portions of the base 102. Therefore, the connecting rod 106 defines a pivotal or rotational axis of the support platform 104 relative to the base 102. The dimension, configuration and overall structure of the support platform 104 cooperate to engage, receive and movably support either foot of the user. As such, predetermined manipulation of the supported user's foot accomplishes an intended and selected pivotal movement and/or orientation of the support platform 104 as clearly represented in FIG. 14. Supporting engagement of the support platform 104 with a preferred foot of the user is further facilitated by the outer or exposed surface of the support platform 104 having a tread-like configuration 108, which will facilitate a gripping or retaining engagement between the under portion of the shoe worn by the user or the foot of the user, when the user is barefoot.

Additional structural features of the base 102 are provided to facilitate placement and positioning of the foot of the individual and include lateral sides as at 110 each extending at least partially upward or outward from the exposed surface or tread configuration 108 of the support platform 104. Further, each of the lateral side portions 110 may include an outwardly extending rail segment 112. Moreover, each of the rail segments 112 may be structured to facilitate attachment to an appropriate connecting or restraining assembly, not shown for purposes of clarity. Such a restraining assembly may be appropriately structured to facilitate the retention of the preferred foot of the user on the support platform 104, while not interfering with the movement of the user's foot and/or the support platform 104 into a preferred or selected orientation relative to the base. Accordingly, each or at least one of the rail segments 112 may include a plurality of apertures or other appropriate structures 114 to accomplish connection of the aforementioned restraining assembly.

As represented in FIG. 14, the cooperative structuring of the support platform 104 and the base 102 allows manipulation of the support platform 104 into one or more orientations which facilitate frictional engagement of the support platform 104 with the supporting surface 200 over which the base 102 travels. More specifically, the support platform 104 includes at least one contact portion 120 integrally or fixedly connected to the support platform 104 so as to extend or protrude outwardly from under surface 104' thereof. Further, the contact portion 120 is preferably, but not necessarily, located adjacent one end 105 of the support platform 104. As such, the at least one contact portion 120 is selectively disposable into frictional engagement with the supporting surface 200 upon a predetermined manipulation of the supported foot of the individual. The establishment of frictional engagement between the one contact portion 120 and the supporting surface 200 serves to selectively influence the velocity of the base 102 dependent, at least in part, on the intent of the rider individual, the predetermined manipulation of the supporting foot and possibly the attitude or orientation of other portions of the user's body.

Therefore, the support platform 104 and at least one contact portion 120 are cooperatively structured and disposed with the base 102 for selective disposition into what may be referred to as a "braking orientation". Such a braking orientation is defined by frictional engagement or contact between the one contact portion 120 and the supporting surface 200. As such, the orientation of the foot and possibly other portions of the rider's body will influence the velocity of the base 102 to the extent of slowing or stopping the travel of the base 102 relative to the supporting surface 200. In contrast, the support platform 104 and contact portion 120 are also cooperatively structured and disposed relative to the base 102 so as to selectively position the contact portion 120 into a frictional engagement with the supporting surface 200 in a manner which defines an "accelerating orientation". Such an accelerating orientation will also be defined by a predetermined position or manipulation of the user's foot and possibly a "forward leaning" or other appropriate attitude or orientation of other portions of the user's body which may facilitate a "push-off" of the base 102 relative to the supporting surface 200. As a result, the velocity of the base 102 will be increased and/or substantially maintained. Accordingly, the selective orientation of the support platform 102 and the contact portion 120 allows the user to dispose the support platform 104 and the contact portion 120 into either of the aforementioned braking orientation or accelerating orientation.

Additional features associated with the preferred embodiment of FIGS. 11-14 include interconnection of each of the spherical wheels 20 to the base 102 utilizing any one of the bearing assemblies 24, 24', etc. as represented in the embodiments of FIGS. 3, 4; 5-7 and/or 8-10. Similarly, appropriate structural embodiments of the mounting assembly 22 will be utilized to accommodate corresponding ones of the above noted embodiments of the bearing assemblies as is structurally appropriate. However, for purposes of clarity, the embodiment of FIGS. 11-14 will preferably, but not necessarily, incorporate the bearing assembly 24' as represented in FIGS. 5-7 and described in detail above. As such, each of the spherical wheels 20 will be movably interconnected to the platform 102 utilizing a mounting assembly 22, as also represented in FIGS. 5-7, in cooperation with the bearing assembly 24'. Moreover, a different one of the bearing assemblies 24' will be structured to movably interconnect each of the spherical wheels 20 to the base 102 so as to facilitate a substantially universal, rotational movement of each of the spherical wheels 20 relative to the base 102 as they movably support the base 102 on the supporting surface 200.

Minor structural modifications may be incorporated in the support platform 102 to accommodate the use of the bearing assembly 24' of FIGS. 5-7. More specifically, one of the retaining plates as at 34' may be integrally or fixedly connected to the appropriate portions of the support platform 102. In contrast, the opposite or cooperating retaining plate 34", as represented in FIGS. 11-14, will be removably connected to the platform in cooperative, corresponding relation to the fixed or integrally formed retaining plate 34' as clearly demonstrated in FIG. 13. The removable features of at least one of retaining plates 34" associated with each of the wheels 20, facilitates easy access to the corresponding spherical wheels 20 and the bearing assemblies 24' associated therewith.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to transport an individual over a supporting surface, said assembly comprising:

a base including a wheel assembly rotationally connected to said base and disposable in moveable engagement with the supporting surface, a support platform movably connected to said base and disposed and structured for supporting engagement with at least one foot of the individual, said support platform selectively disposable into and out of confronting relation to the supporting surface upon predetermined manipulation of the one foot, said support platform comprising at least one contact portion disposable into engagement with the supporting surface in a manner which at least partially influences a velocity of said base, said wheel assembly comprising at least one wheel; a bearing assembly disposed in movable, retaining engagement with an exterior surface of said one wheel and in interconnecting relation between said one wheel and said base, said bearing assembly and said one wheel cooperatively disposed and structured to facilitate a substantially universal range of motion of said one wheel relative to said base, said bearing assembly comprising a first portion and a second portion collectively and movably interconnecting said one wheel to said base; said first and second portions disposed and structured to facilitate a substantially universal rotational range of motion of said one wheel relative to said base, and an axle extending through a center of said one wheel and at least partially defining at least one rotational axis of said one wheel.

2. An assembly as recited in claim 1 wherein said wheel assembly includes at least one wheel having a spherical configuration, a bearing assembly structured to movably interconnect said one wheel to said base, said bearing assembly cooperatively structured with said base to facilitate substantially universal, rotational movement of the one wheel relative to said base.

3. An assembly as recited in claim 1 wherein said one contact portion is disposed in outwardly extending relation to an under surface of said support platform.

4. An assembly as recited in claim 3 wherein said one contact portion is disposed at one end of said support platform.

5. An assembly as recited in claim 4 wherein said one contact portion is disposed on and extending outwardly from an under surface of a leading end of said support platform.

6. An assembly as recited in claim 4 wherein said one end and said one contact portion are pivotally disposable beneath said base into confronting relation with the supporting surface.

7. An assembly as recited in claim 6 wherein said support platform and said one contact portion are cooperatively structured with said base for selective disposition of said support platform and said one contact portion into a braking orientation relative to the supporting surface upon predetermined orientation of the one foot.

8. An assembly as recited in claim 7 wherein said support platform and said one contact portion are cooperatively structured with said base for selective disposition of said support platform and said one contact portion into an accelerating orientation relative to the supporting surface upon predetermined orientation of the one foot.

9. An assembly as recited in claim 1 wherein said support platform and said one contact portion are cooperatively structured with said base for selective disposition of said support platform and said one contact portion into a braking orientation relative to the supporting surface.

10. An assembly as recited in claim 9 wherein said support platform and said one contact portion are cooperatively structured with said base for selected disposition of said support platform and said one contact portion into an accelerating orientation relative to the supporting surface.

11. An assembly as recited in claim 1 wherein said bearing assembly comprises two bearing sections disposed in retaining engagement with said exterior surface and in continuous surrounding relation to said exterior surface and in spaced relation to one another.

12. An assembly as recited in claim 11 wherein each of said bearing sections comprises a plurality of bearings collectively disposed in continuous, surrounding engagement with said exterior surface of said one wheel.

13. An assembly as recited in claim 1 further comprising a mounting assembly disposed in retaining engagement with said bearing assembly; said bearing assembly disposed in interconnecting relation between said one wheel and said mounting assembly.

14. An assembly as recited in claim 13 wherein said mounting assembly comprises at least one retaining plate removably connected to said base and having an annular configuration including a central aperture extending through said retaining plate and an outer peripheral portion connected to said base.

15. An assembly as recited in claim 14 wherein said one wheel is movably disposed within said central aperture in concurrent, outwardly protruding relation to said one retaining plate and opposite surfaces of said base.

16. An assembly as recited in claim 1 wherein said first portion of said bearing assembly is disposed in movable interconnecting relation between said axle and said one wheel; said second bearing portion disposed in movable, interconnecting relation between said axle and said base.

17. An assembly structured to transport an individual over a supporting surface, said assembly comprising:

a base including a wheel assembly rotationally connected to said base and disposable in moveable engagement with the supporting surface, said wheel assembly comprising at least two wheels each having a spherical configuration and concurrently extending outwardly from oppositely disposed surfaces of said base, at least two bearing assemblies each disposed and structured to movably connect a different one of said two wheels to said base, each of said bearing assemblies disposed and structured to facilitate a substantially universal, rotational movement of a corresponding one of said wheels relative to said base, a support platform movably connected to said base and disposed and structured for supporting engagement with at least one foot of the individual, said support platform comprising at least one contact portion disposable into and out of engagement with the supporting surface, said one contact portion selectively positionable to at least partially influence a velocity of said base relative to the supporting surface, at least one of said bearing assemblies comprising a first portion and a second portion collectively and movably interconnecting said one wheel to said platform; said first and second portions disposed and structured to facilitate a substantially universal range of motion of said one wheel relative to said base, and an axle extending through a center of said one wheel and at least partially defining at least one rotational axis of said one wheel.

18. An assembly as recited in claim 17 wherein said support platform is pivotally connected to said base and disposed intermediate said two wheels.

19. An assembly as recited in claim 17 wherein said support platform and said one contact portion are cooperatively structured with said base for selective disposition of said support platform and said one contact portion into a braking orientation relative to the supporting surface.

20. An assembly as recited in claim 19 wherein said support platform and said one contact portion are cooperatively structured with said base for selective disposition of said support platform and said one contact portion into an accelerating orientation relative to the supporting surface.

21. An assembly as recited in claim 17 wherein said support platform and said one contact portion are cooperatively structured with said base for selective disposition of said support platform and said one contact portion into an accelerating orientation relative to the supporting surface.

22. An assembly as recited in claim 17 wherein said first portion of said bearing assembly is disposed in movable interconnecting relation between said axle and said one wheel; said second bearing portion disposed in movable, interconnecting relation between said axle and said base.

* * * * *